United States Patent [19]

Watson

[11] Patent Number: 4,992,066

[45] Date of Patent: Feb. 12, 1991

[54] MARINE MOTOR TRANSMISSION

[76] Inventor: Robert K. Watson, P.O. Box 127, Ridgetown, Ontario, Canada, N0P 2C0

[21] Appl. No.: 386,702

[22] Filed: Jul. 28, 1989

[51] Int. Cl.[5] ..... B63H 23/00

[52] U.S. Cl. ..... 440/75; 474/101; 474/111

[58] Field of Search ..... 440/75, 900; 474/101, 474/111, 112, 134

[56] References Cited

U.S. PATENT DOCUMENTS

| | | | |
|---|---|---|---|
| 417,512 | 12/1889 | Rosquist | 474/134 X |
| 2,345,689 | 4/1944 | Snadecki | 440/75 X |
| 2,486,574 | 11/1949 | Roof | 440/75 |
| 3,403,655 | 10/1968 | Warburton | 440/75 X |
| 3,759,111 | 9/1973 | Hoff | 474/14 |
| 4,869,692 | 9/1989 | Newman | 440/75 |

*Primary Examiner*—Sherman Basinger
*Attorney, Agent, or Firm*—Smart & Biggar

[57] ABSTRACT

In a propeller driven outboard or inboard-outboard marine motor, the typical transmission comprising a transmission shaft coupled to the propeller shaft by bevel gears is replaced by a chain drive between the propeller shaft and a parallel output shaft coupled to the power plant of the motor. Torque is applied to the chain drive through a torque dependent variable pulley coupled by a belt to a speed dependent variable pulley which allow for a variable gear ratio. A chain tensioning means maintains tension on the chain.

10 Claims, 2 Drawing Sheets

MARINE MOTOR TRANSMISSION

This relates to a transmission for a marine motor, and more particularly, for an outboard motor or an inboard-outboard motor for watercraft.

In known outboard and inboard-outboard motors, the power plant is typically coupled through a variable transmission to a transmission shaft. The transmission shaft is coupled to the propeller shaft of the motor through a gear box which contains a bevel gear fixed to the transmission shaft and a meshing bevel gear fixed to the propeller shaft. A housing surrounds the propeller shaft, gear box and the lower portion of the transmission shaft. It is desirable to minimize the width of at least the portion of this housing which is immersed in normal operation in order to reduce the drag of the housing in the water; this is of particular importance in high performance watercraft. On the other hand, in high performance motors, it is desirable to transmit high levels of torque through to the propeller. This points to larger bevel gears to handle such torque. However, larger bevel gears are incompatible With the need to maintain a narrow housing.

Accordingly, there is a need for a transmission for outboard and inboard-outboard motors which has high torque transmission characteristics and permits a narrow housing.

According to the invention, there is provided a transmission for a propeller driven outboard or inboard-outboard marine motor comprising the following: a speed dependent variable pulley coupled to the output of the power plant; a torque dependant variable pulley radially spaced from said speed dependant variable pulley and coupled to a chain or belt driver means; a belt means interengaging said speed dependant variable pulley and said torque dependant variable pulley; means to couple the output of the power plant of said marine motor to chain or belt drive means: a propeller shaft spaced radially from said chain or belt drive means supporting chain or belt driven means; endless chain or belt means interengaging said chain or belt drive means and said chain or belt driven means; a propeller supported by said propeller shaft; and a housing enclosing said chain or belt driven means.

Figure 1:
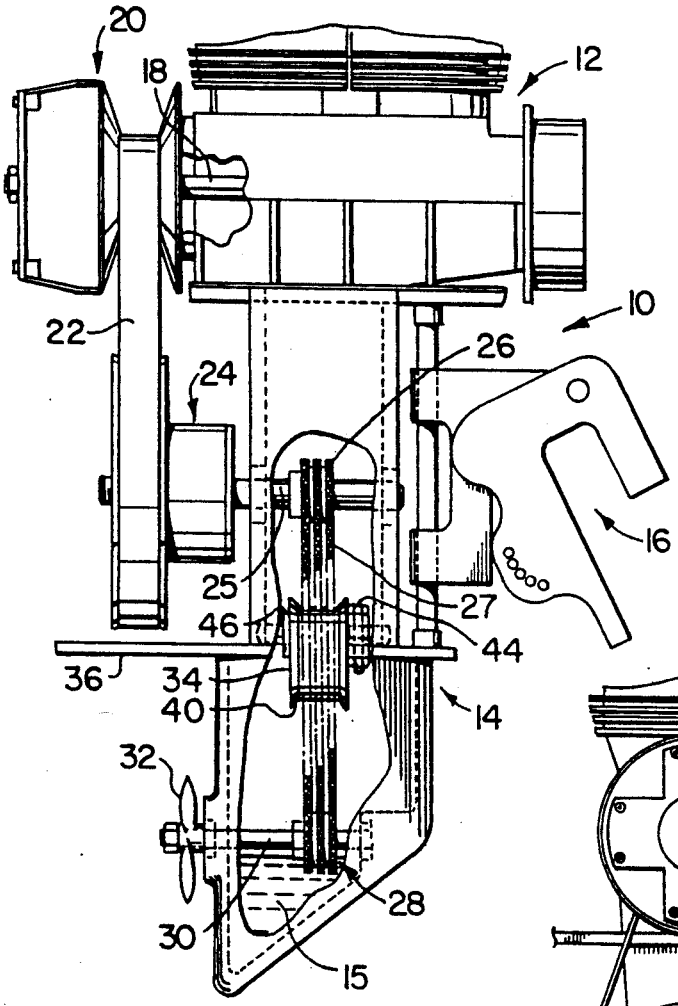
Figure 2:
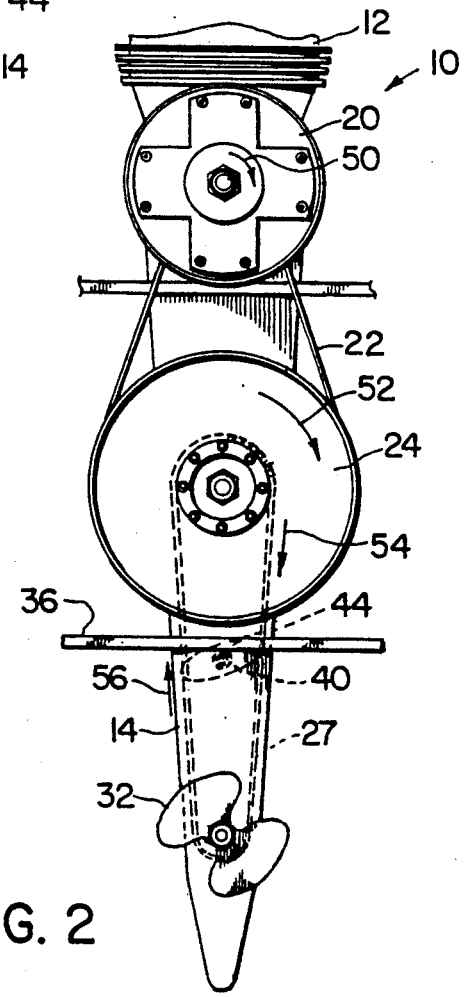
Figure 3:
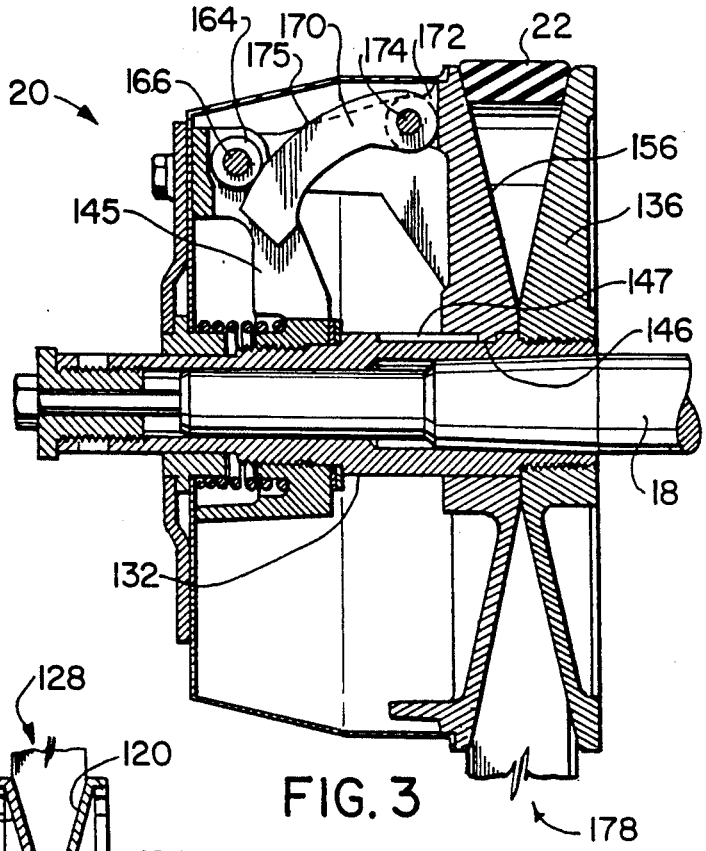
Figure 4:
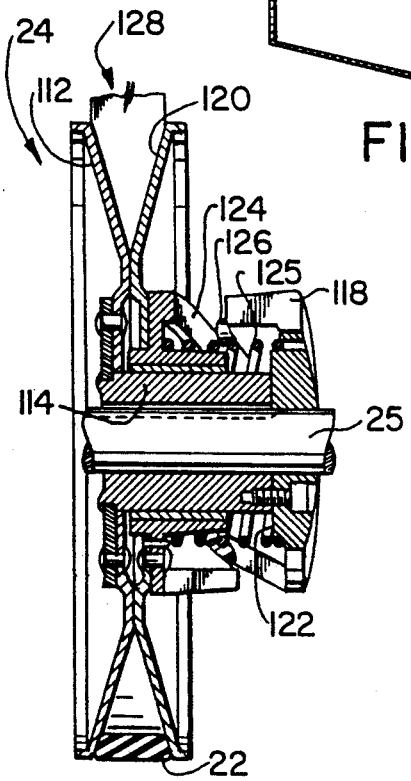
Figure 5:
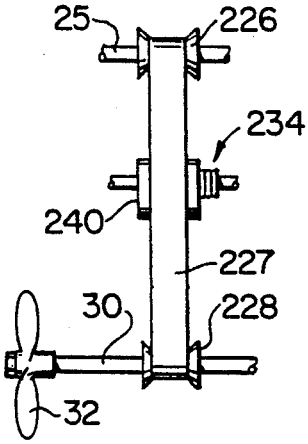

In the FIGS. which detail example embodiments of the invention:

FIG. 1 is a side view of an outboard motor constructed in accordance with this invention, FIG. 2 is a rear view of the outboard motor of FIG. 1, FIG. 3 is a cross-sectional side view of a portion of the outboard motor of FIGS. 1 and 2, FIG. 4 is a cross-sectional side view of another portion of the outboard motor of FIGS. 1 and 2, and FIG. 5 is a schematic partial side view of an outboard motor constructed in accordance with another embodiment of this invention.

With reference to FIGS. 1 and 2, an outboard motor is indicated generally at 10. The outboard motor comprises a power plant 12 and a housing 14. A standard mount is utilized in mounting the motor to a watercraft. The drive shaft 18 from the power plant 12 terminates in speed dependant variable pulley 20. Belt 22 couples the speed dependant variable pulley with torque dependant variable pulley 24. The output shaft 25 of torque dependant variable pulley 24 supports chain driver means, namely, triple sprocket 26. Three endless chains 27 couple triple sprocket 26 With radially spaced propeller shaft chain driven means, namely, triple sprocket 28, the latter being supported by propeller shaft 30. Propeller shaft 30 terminates in propeller 32. A chain tensioner 34 is supported at a medial location within the loop formed by the endless chains.

Chain tensioner 34 comprises a generally oval cam 40 supported by shaft 46. A wound spring 44, mounted at one end to shaft 46 and at the other end to cam 40, urges cam 40 to rotate to a position wherein the cam abuts generally opposed sides of endless chains 27. In the rear view of FIG. 2, wound spring 44 is seen to urge cam 40 in a clockwise direction.

Housing 14 is sealed so as to provide an oil reservoir for oil 15. Splash guard 36, supported by housing 14, projects beyond torque dependent variable pulley 24.

The speed dependant variable pulley is detailed in FIG. 3. Collar 132 is fixed to drive shaft 18 and fixed pulley flange 136 is fixed to the collar. Roller supports, one of which is illustrated at 145, are also fixed to the collar 132. The roller supports support rollers 164 on roller pins 166. Slidable pulley flange 156 is keyed to collar 132 by key 146 in keyway 147 which permits pulley flange 156 to slide along collar 132. The slidable pulley flange has swing arm mounts, one of which is illustrated at 172, with pins 174 Which swingably support swing arms 170. Swing arms 170 have a curved outer cam face 175. Belt 22 is held in the V-shaped opening 178 betWeen the pulley flanges.

FIG. 4 details the torque dependent variable pulley 24. Fixed pulley flange 112 is fixedly mounted to collar 114 which is fixedly mounted to output shaft 25. Moveable pulley shaft 120 is mounted to collar 114 so as to be able to slide along the collar and rotate with respect to the collar. Moveable pulley flange 120 carries helical cam 124. Helical cam 118 is carried by the collar 114. The helical cam 118 carries cam folloWer pads 126 and abuts helical cam 124. A spring 125 positioned between shoulder 122 of collar 114 and moveable pulley flange 114 urges moveable pulley flange 120 toward fixed pulley flange 112. Belt 22 is held in the V-shaped opening 128 between the pulley flanges.

Further details of a suitable speed dependent variable pulley and a torque dependent variable pulley may be found in U.S. Pat. No. 3,759,111 to Hoff issued Sep. 18, 1973.

The operation of the seed dependent variable pulley 20 is next considered. When the power plant 12 is rotating its drive shaft 18 at low rpm, swing arms 170 of slidable pulley flange 156 are not pushed against rollers 164 with any force and so slidable pulley flange 156 is free to slide along collar 132 in a direction away from fixed pulley flange 136. This allows belt 22 to sink toward collar 132 at the base of the flanges, as illustrated in FIG. 1, and to thereby relax so that the rotary motion of drive shaft 18 is not coupled through to propeller 32. On the other hand, as the rpm of the drive shaft increases, the swing arms 170 impact rollers 164 with increasing force so that the cam surfaces 175 of the swing arms interact with the rollers 164 to provide an axial thrust on slidable pulley flange 156 in the direction of fixed pulley flange 136 that varies With the speed of the drive shaft. If unopposed by the torque dependent variable pulley, this will result in the slidable pulley flange moving toward the fixed pulley flange, thereby narrowing the V-shaped groove between the flanges and forcing the belt 22 to the periphery of the pulley.

The operation of the torque dependent variable pulley is as follows. When the speed of the speed dependent variable pulley 20 increases so as to urge the belt 22 toward the periphery of that pulley, the belt tends to be pulled deeper into the V-groove of the torque dependent variable pulley 24, with moveable pulley flange 120 moving away from fixed flange 112 against the urging of spring 125 This is the result so long as the torque on output shaft 25 is minimal. As the torque on output shaft 25 increases, helical cam 118 attempts to cam helical cam 124 in order to force moveable pulley flange 120 toward fixed pulley flange 112.

In the result, with high drive shaft speeds and low reaction torque at the output, the transmission ratio between the variable pulleys will be high. On the other hand, with low drive shaft speeds and high reaction torque at the output, the transmission ratio between the variable pulleys will be low. In intermediate situations, the transmission ratio will adjust depending on the factors of drive shaft speed and output reaction torque.

Output torque on output shaft 25 is transmitted to chain sprocket 26 and then by endless chains 27 to chain sprocket 28 and propeller shaft 30.

The power plant 12 rotates drive shaft 18 is in a clockwise direction when viewed from the rear, as is illustrated in FIG. 2 at 50. This drives output shaft 25 in the same sense, as is illustrated in FIG. 2 at 52. Hence chains 27 are driven in this clockwise sense, as illustrated at 54 and 56. The portion of the chains contacting either end of cam 40 frictionally engage the cam and thereby impart a clockwise torque on the cam 40. This torque increases the tension of the chains. Thus, chain tension increases with the circulating speed of the chains since sliding friction varies directly with speed.

When chains 27 are circulating they pick up oil from reservoir 15.

A sprocket-chain arrangement provides at least five times the strength of a bevel gear arrangement. By way of example, a triple row chain is capable of transmitting 500 foot-pounds of torque in a width of less than two inches. Consequently, the described arrangement allows the portion of housing 14 which is normally immersed in water to have a very narrow width and yet have high torque transmitting characteristics.

In an alternate embodiment illustrated in FIG. 5, chain sprockets 26 and 28 are replaced by belt pulleys 226 and 228 and endless chains 27 are replaced by belt 227. Similarly, chain tensioner 34 is replaced by belt tensioner 234 which may be of similar construction to chain tensioner 34 but may have rollers (not shown) on the cam 240 to reduce the friction between the belt 227 and the cam 240.

The embodiments in which an exclusive property or privilege is claimed are as followed:

1. A transmission for a propeller driven outboard marine motor comprising the following:

(a) a speed dependant variable pulley coupled to the output of the power plant of said marine motor;

(b) a torque dependant variable pulley radially spaced from said speed dependant variable pulley and coupled to a chain or belt driver means;

(c) an endless belt means interengaging said speed dependant variable pulley and said torque dependant variable pulley;

(d) a propeller shaft spaced radially from said chain or belt driver means supporting chain or belt driven means;

(e) endless chain or belt means interengaging said chain or belt driver means and said chain or belt driven means;

(f) a propeller supported by said propeller shaft;

(g) a chain or belt tensioning means for maintaining tension on said endless chain or belt means comprising means to urge a cam against generally opposed sides of said endless chain or belt means; and (h) a housing enclosing said chain or belt driven means.

2. The transmission of claim 1 wherein said chain or belt driver means and said chain or belt driven means comprise sprocket means and wherein said endless chain or belt means comprise endless chain means.

3. The transmission of claim 1 wherein said chain or belt driver means and said chain or belt driven means comprise pulley means and wherein said endless chain or belt means comprise endless belt means.

4. The transmission of claim 1 wherein said output of the power plant of said marine motor comprises an output shaft and wherein said speed dependent variable pulley comprises:

(a) a speed dependant variable pulley flange fixed to said output shaft of said power plant;

(b) a moveable speed dependant variable pulley flange keyed for axial sliding on said output shaft;

(c) an abutment fixed to said output shaft;

(d) an arm pivotably mounted to said moveable speed dependent variable pulley flange having a camming surface for camming against said abutment when centrifugal forces urge said arm against said abutment in order to urge said moveable speed dependant variable pulley flange toward said fixed speed dependent variable pulley flange.

5. The transmission of claim 4 wherein said torque dependent variable pulley comprises:

(a) a torque dependant variable pulley output shaft coupling said torque dependant variable pulley to said chain or belt driver means;

(b) a torque dependant variable pulley flange fixed to said output shaft of said torque dependent variable pulley;

(c) a moveable torque dependant variable pulley flange slidably and rotatably mounted to said output shaft of said torque dependent variable pulley, said moveable torque dependent variable pulley flange supporting a first helical cam;

(d) a second helical cam supported by said output shaft of said torque dependant variable pulley in abutting relation with said first helical cam such that torque loading on said output shaft of said torque dependent variable pulley tends to urge said moveable torque dependent variable pulley flange toward said fixed torque dependent variable pulley flange; and (e) urging means to urge said moveable torque dependent variable pulley flange towards the fixed torque dependent variable pulley flanges.

6. A transmission for a propeller driven outboard marine motor comprising the following:

(a) a speed dependent variable pulley coupled to the output of the power plant of said marine motor;

(b) a torque dependent variable pulley radially spaced from said speed dependent variable pulley and coupled to an output shaft;

(c) a belt means interengaging said speed dependent variable pulley and said torque dependent variable pulley;

(d) chain or belt driver means supported for rotation with said output shaft;

(e) a propeller shaft radially spaced from said output shaft;

(f) chain or belt driven means supported for rotation with said propeller shaft;

(g) a propeller supported by said propeller shaft;

(h) endless chain or belt means operatively associated with said chain or belt driver means and said chain or belt driven means;

(i) a chain or belt tensioning means for maintaining tension on said endless chain or belt means comprising means to urge a cam against generally opposed sides of said endless chain or belt means; and (j) a housing enclosing said chain or belt driven means.

7. The transmission of claim 6 wherein said chain or belt driver means and said chain or belt driven means comprise sprocket means and wherein said endless chain or belt means comprise endless chain means.

8. The transmission of claim 6 wherein said chain or belt driver means and said chain or belt driven means comprise pulley means and wherein said endless chain or belt means comprise endless belt means.

9. The transmission of claim 6 wherein said output of the power plant of said marine motor comprises an output shaft and wherein said speed dependent variable pulley comprises:

(a) a speed dependent variable pulley flange fixed to said output shaft of said power plant;

(b) a moveable speed dependent variable pulley flange keyed for axial sliding on said output shaft;

(c) an abutment fixed to said output shaft;

(d) an arm pivotably mounted to said moveable speed dependent variable pulley flange having a camming surface for camming against said abutment when centrifugal forces urge said arm against said abutment in order to urge said moveable speed dependent variable pulley flange toward said fixed speed dependent variable pulley flange.

10. The transmission of claim 9 wherein said torque dependent variable pulley comprises:

(a) a torque dependent variable pulley flange fixed to said output shaft of said torque dependent variable pulley;

(b) a moveable torque dependent variable pulley flange slidably and rotatably mounted to said output shaft of said torque dependent variable pulley, said moveable torque dependent variable pulley flange supporting a first helical cam;

(c) a second helical cam supported by said output shaft of said torque dependent variable pulley in abutting relation with said first helical cam such that torque loading on said output shaft of said torque dependent variable pulley tends to urge said moveable torque dependent variable pulley flange toward said fixed torque dependent variable pulley flange; and (d) urging means to urge said moveable torque dependent variable pulley flange towards the fixed torque dependent variable pulley flange.

* * * * *